US007147211B2

(12) United States Patent
Porter

(10) Patent No.: US 7,147,211 B2
(45) Date of Patent: Dec. 12, 2006

(54) HYDRAULIC JACK STAND

(76) Inventor: Rodney Porter, 3862 Twinmont St., Memphis, TN (US) 38128

( * ) Notice: Subject to any disclaimer, the term of this patent is extended or adjusted under 35 U.S.C. 154(b) by 0 days.

(21) Appl. No.: 11/406,286

(22) Filed: Apr. 19, 2006

(65) Prior Publication Data

US 2006/0237699 A1 Oct. 26, 2006

Related U.S. Application Data

(60) Provisional application No. 60/673,799, filed on Apr. 22, 2005.

(51) Int. Cl.
*B66F 3/24* (2006.01)

(52) U.S. Cl. ..... 254/93 H; 254/93 R; 254/93 L; 254/89 H

(58) Field of Classification Search ..... 254/93 H, 254/89 H, 93 L, 93 R, 93 HP, 92, 102
See application file for complete search history.

(56) References Cited

U.S. PATENT DOCUMENTS 2,529,292 A * 11/1950 Greenfield ..... 248/354.6
2,599,900 A * 6/1952 Donohue ..... 254/95
3,920,212 A 11/1975 Westwood
4,330,104 A 5/1982 Klok
4,553,727 A 11/1985 Arzouman
5,009,394 A * 4/1991 Marshall ..... 254/30
5,110,089 A 5/1992 Slay
5,180,131 A 1/1993 Few
5,915,672 A * 6/1999 Dickey ..... 254/133 R
6,027,102 A 2/2000 Krupa
6,443,413 B1 9/2002 Hawkins et al.
6,581,921 B1 * 6/2003 Griggs ..... 269/37
6,648,299 B1 11/2003 Arzouman

* cited by examiner

*Primary Examiner*—Lee D. Wilson
(74) *Attorney, Agent, or Firm*—Richard C. Litman

(57) ABSTRACT

The hydraulic jack stand is a hydraulic jack with an integral jack stand. The jack stand helps stabilize and support a heavy object being lifted by the jack. The hydraulic jack stand uses multiple parallel safety mechanisms to prevent the jack from lowering unexpectedly while being used as a jack stand. The jack uses hydraulic pressure to raise and lower a lifting post. Pivoting teeth arranged along the lifting post allow the lifting post to be raised while preventing the post from falling due to any failure in the hydraulic cylinder. The jack stand has several legs, which extend out to provide a wide base. The legs have feet with non-slip pads underneath to protect the legs from wear and to help prevent the stand from slipping.

15 Claims, 6 Drawing Sheets

HYDRAULIC JACK STAND

CROSS-REFERENCE TO RELATED APPLICATION

This application claims the benefit of U.S. Provisional Patent Application Ser. No. 60/673,799, filed Apr. 22, 2005.

BACKGROUND OF THE INVENTION

1. Field of the Invention

The present invention relates to hydraulic jacks and devices used to stabilize hydraulic jacks while supporting a heavy object. More specifically, the device is a hydraulic jack with an integral jack stand.

2. Description of the Related Art

Hydraulic jacks are often used to raise a motor vehicle off the ground, to allow the vehicle to be repaired. However, these jacks lack the stability to maintain the vehicle in that position safely while a person works under the vehicle. Jack stands have been developed to support the vehicle in a stable, safe manner once the vehicle has been raised off the ground. These jack stands usually have a wide support base and do not raise or lower, so that there is little chance of one accidentally failing and allowing the vehicle to lower unexpectedly.

Typically, the user must first raise the vehicle using the jack, and then slide the jack stand into place before removing the jack. The process must then be reversed to lower the vehicle back down to the ground. Because this process takes time, and requires that the person performing the work must have both parts nearby, jack stands have been created that allow a user to use a jack in conjunction with a jack to raise and support the vehicle all at once.

However, a jack stand that is integrated into a hydraulic jack body, with multiple parallel safety mechanisms to prevent unintended, accidental falling of the vehicle due to failure of the jack is needed. Thus a hydraulic jack stand solving the aforementioned problems is desired.

SUMMARY OF THE INVENTION

The hydraulic jack stand is a hydraulic jack with an integral jack stand. The jack stand helps stabilize and support the heavy object being lifted by the jack. By combining the jack stand and a hydraulic jack, the user needs only one piece of equipment to raise, support and lower a heavy object such as a vehicle.

The hydraulic jack stand uses multiple parallel safety mechanisms to prevent the jack from lowering unexpectedly while being used as a jack stand. The jack uses hydraulic pressure to raise and lower a lifting post and seat. The lifting post fits into an opening in the top of a hydraulic cylinder. A handle extends from the hydraulic cylinder and is used to operate the jack. By pumping the handle, hydraulic fluid is forced into a chamber under a piston beneath the lifting post. The post rises due to the hydraulic pressure action of the jack. To lower the seat and post, the handle is rotated to open a valve in the chamber and release the hydraulic fluid from the chamber, lowering the lifting post and seat.

Pivoting teeth are arranged along the lifting post to allow the lifting post to be raised, while preventing the post from falling due to any failure in the hydraulic cylinder. The pivoting teeth are secured to the lifting post by hinges that allow the teeth to pivot inward but not outward. The teeth are spring-urged outwardly, so that they naturally point away from the lifting post, and some force must be applied to them to pivot them in against the side of the lifting post. The teeth are spaced apart in regular intervals vertically along the side of the lifting post.

A guide support may be located in the top of the hydraulic cylinder, and is used to support the teeth and prevent the lifting post from lowering unintentionally. This guide support will hold the lifting post in place, even if the hydraulic chamber ruptures or fails. The guide support may be slid out from underneath the teeth in order to allow the lifting post to be lowered. This release of the guide support may be actuated by the hydraulic pump handle, or may be done with a separate lever, switch or button.

At the top of the lifting post, a curved support surface is provided to allow an object being lifted to rest on the lifting post in a stable manner. The lifting post may have only one curved support surface, or the post may have smaller support surfaces on either side of a larger, central support surface. These additional support surfaces allow the user to support more than one element of the object being lifted, providing greater security and stability.

The jack stand has several legs, which extend out to provide a wide base. The legs generally splay downward from the top of the hydraulic cylinder, and are wider near the bottom of each leg than at the top. The legs are slightly curved in cross-section, to provide greater strength, and have flat, horizontal feet to help stabilize the stand on a support surface. The feet have pads underneath to protect the feet from wear and to help prevent the stand from slipping. The pads are made from a durable, elastic material such as rubber or a closed cell foam material.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
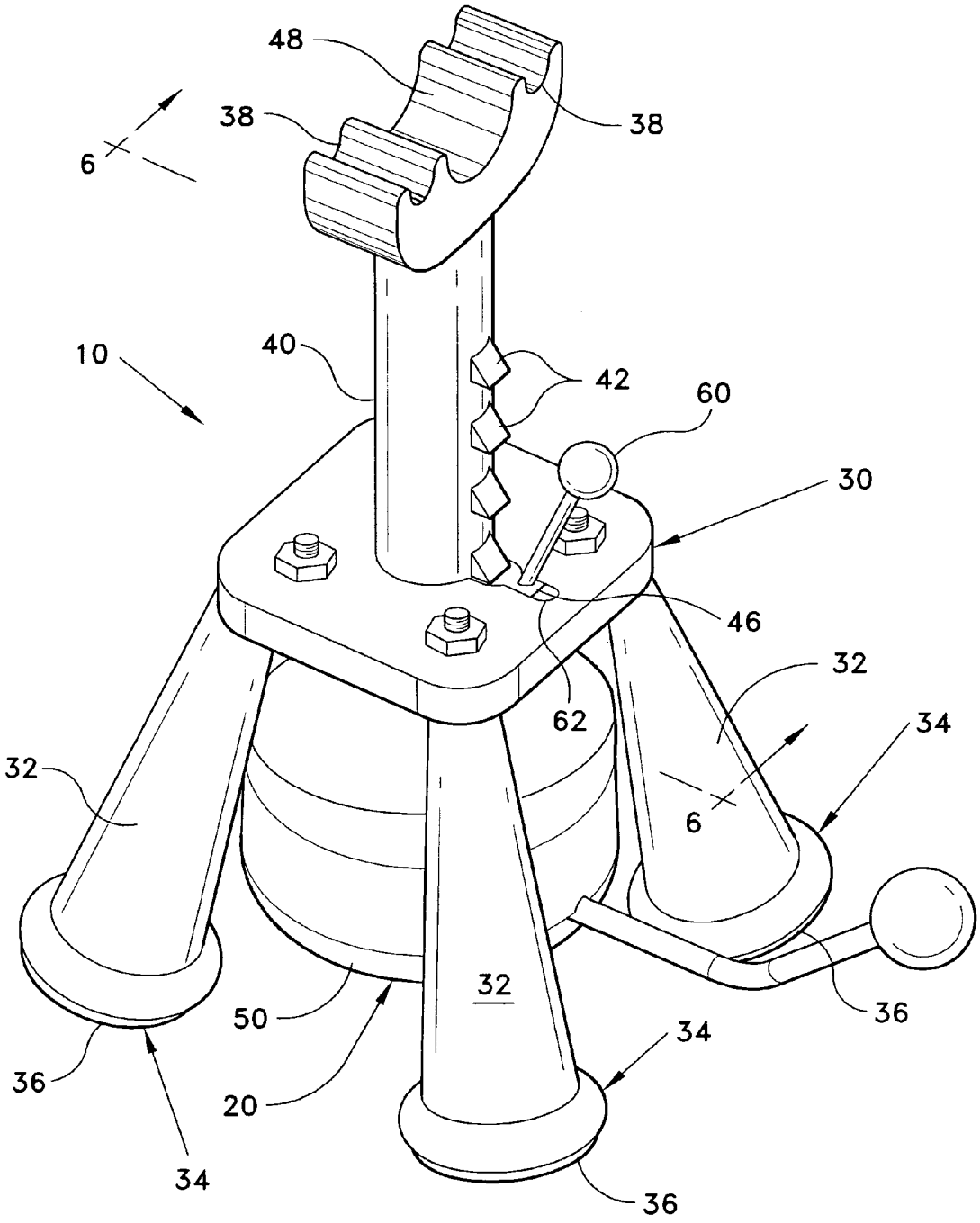
FIG. 1 is a perspective view of a hydraulic jack stand according to the present invention.
Figure 5:
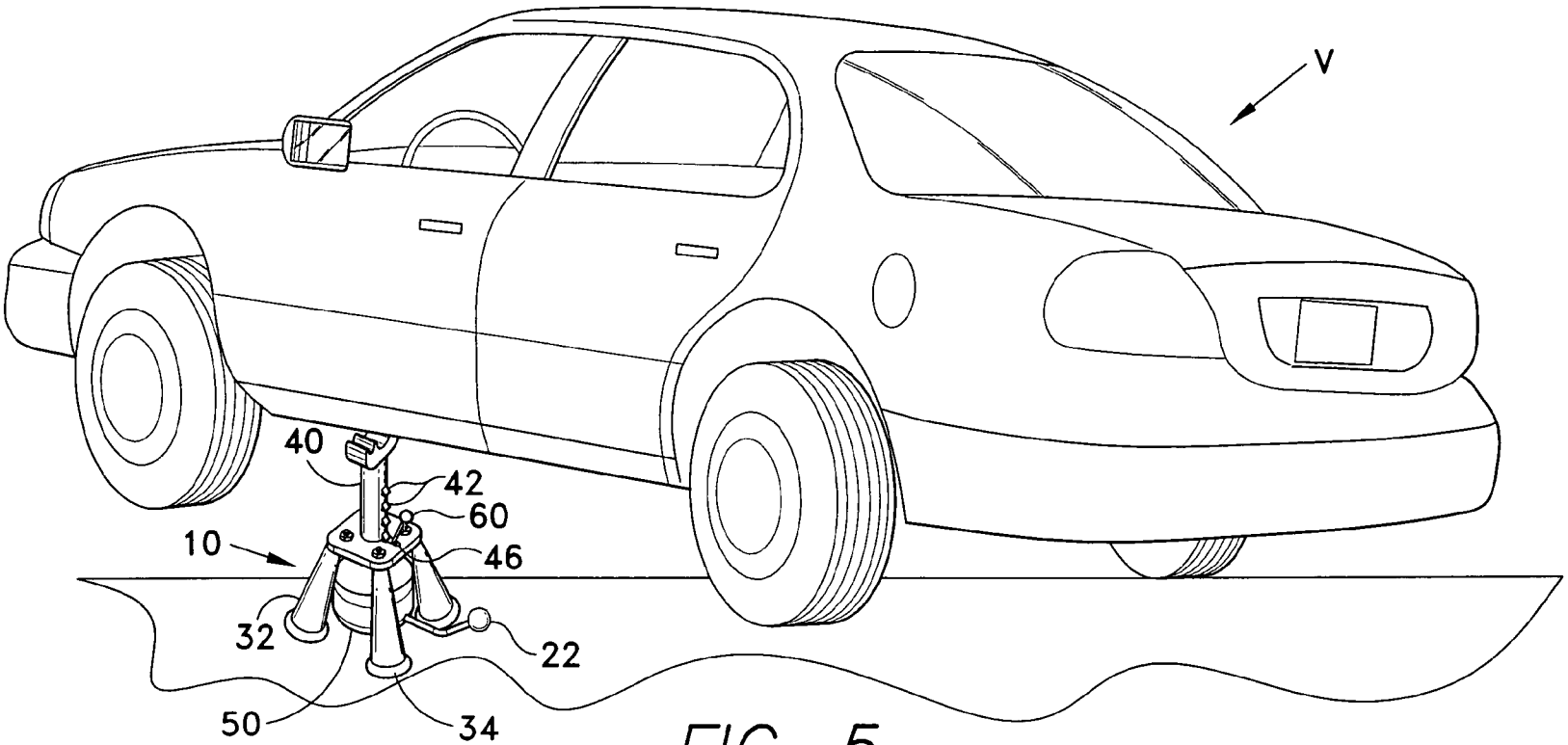
FIG. 5 is an environmental perspective view of hydraulic jack stand according to present invention.

The present invention is a hydraulic jack stand, designated generally as 10. As shown in FIG. 1, the hydraulic jack stand 10 has a hydraulic jack 20 with an integral jack stand 30. The jack stand 30 helps stabilize and support the heavy object being lifted by the jack 20. By combining the jack stand 30 and a hydraulic jack 20, the user needs only one piece of equipment to raise, support and lower a heavy object such as a vehicle V (see FIG. 5).

Figure 4:
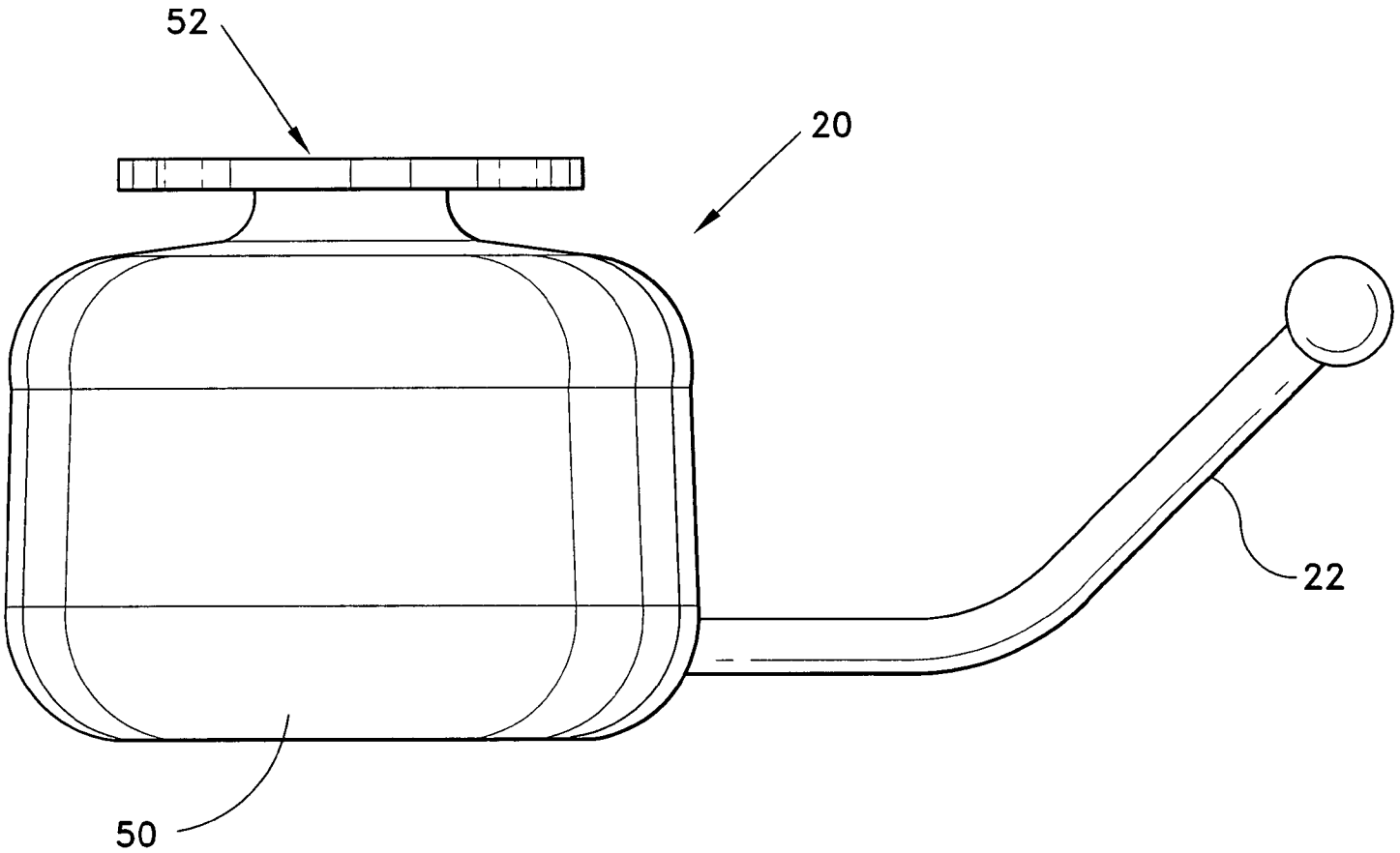
FIG. 4 is a side view of hydraulic jack cylinder and handle according to present invention.

The hydraulic jack stand 10 uses multiple parallel safety mechanisms to prevent the jack 20 from lowering unexpectedly while being used as a jack stand. The jack 20 uses hydraulic pressure to raise and lower a lifting post 40. Referring to FIG. 4, post 40 fits into an opening 52 in the top of a hydraulic cylinder 50. A handle 22 extends from the hydraulic cylinder 50 and is used to operate the jack 20. By pumping the handle 22, hydraulic fluid is forced into a chamber in cylinder 50, beneath a piston (not shown) under the lifting post 40. The post rises due to the hydraulic action of the jack 20. To lower the post 40, the handle 22 is rotated to open a valve in the cylinder 50, and release pressure beneath the piston and post 40, so that the post and its seat will lower. Details of interior construction of the hydraulic jack 20 are not detailed here, as they are well known to those skilled in the art.

Figure 2:
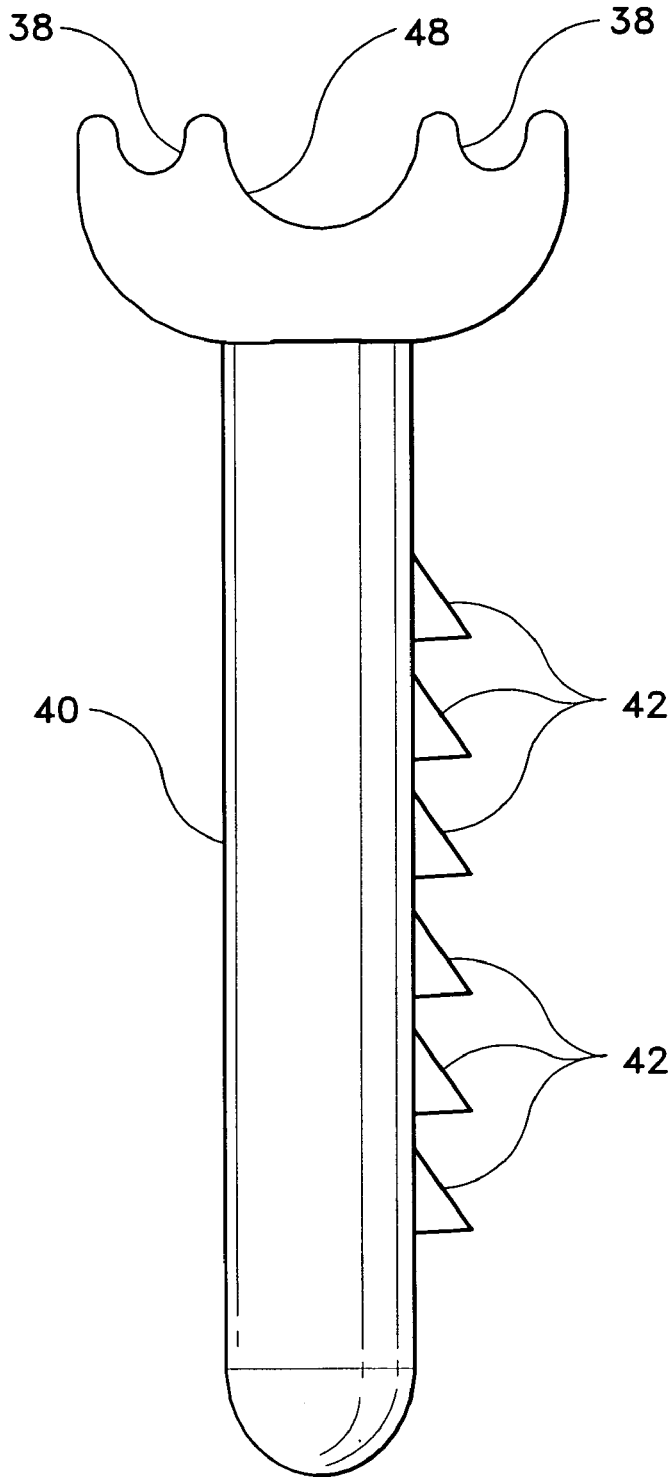
FIG. 2 is a side view of hydraulic jack support post with teeth according to the present invention.
Figure 6:
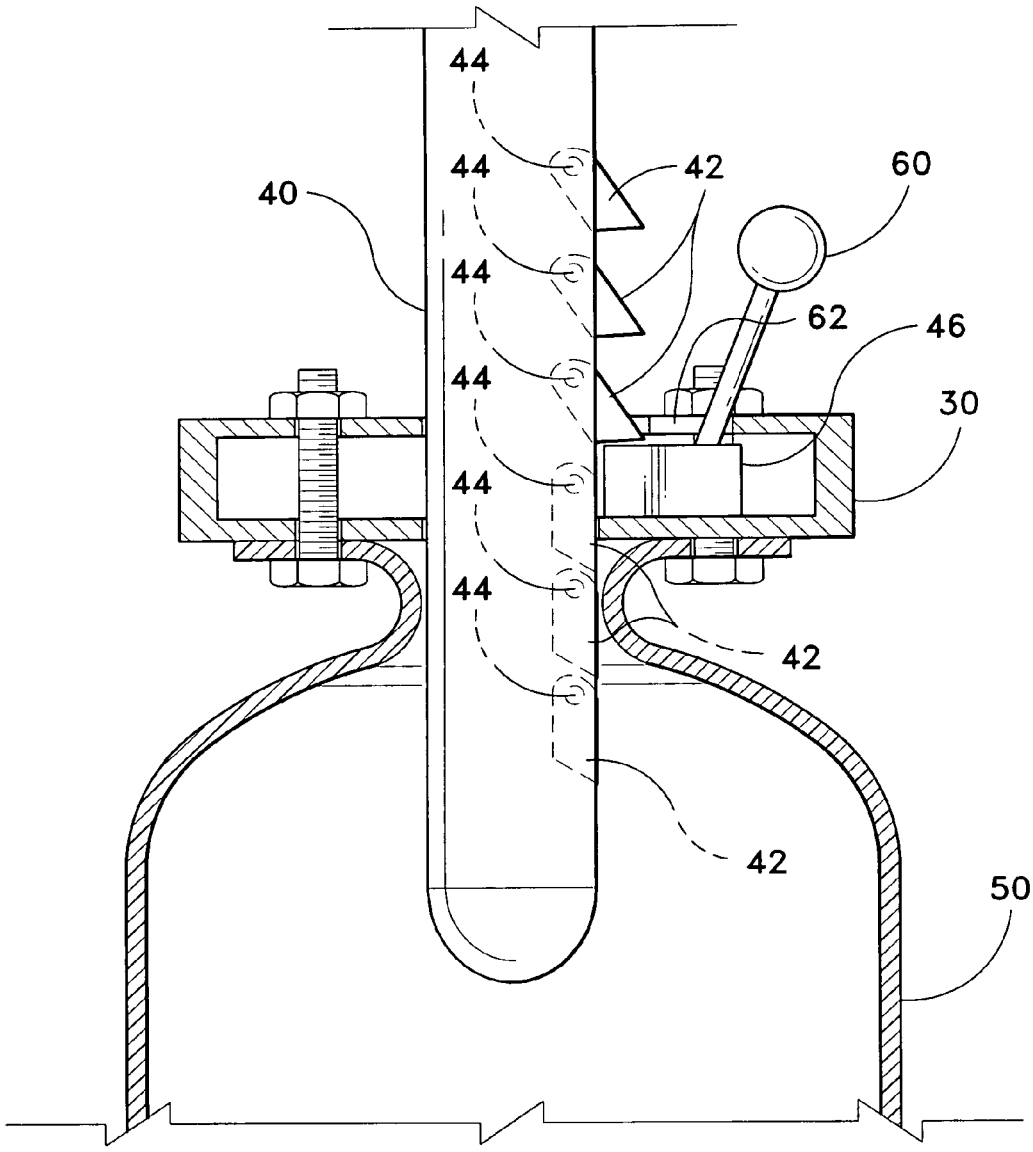
FIG. 6 is a cross-section view of guide support for hydraulic jack stand according to present invention.

As shown in FIG. 2, pivoting teeth 42 are arranged along the lifting post 40 to allow the lifting post 40 to be raised, while preventing the post 40 from falling due to any failure in the hydraulic cylinder 50. Referring to FIG. 6, the pivoting teeth 52 are secured to the lifting post 40 by hinges 44 that allow the teeth 42 to pivot in and out. The teeth 42 are spring-biased, and urged away from post 40, so that they naturally extend away from the lifting post 40, and some force must be applied to them to pivot them in against the side of the lifting post 40. The teeth 42 are spaced apart in regular intervals vertically along the side of the lifting post 40.

A guide support 46 may be located in the jack stand 30, adjacent to the lifting post 40, and is used to support the teeth 42 and prevent the lifting post 40 from lowering unintentionally. This guide support 46 will hold the lifting post 40 in place, even if the hydraulic chamber ruptures or fails. The guide support 46 may be slid out from underneath the teeth 42 in order to allow the lifting post 40 to be lowered. This release of the guide support 46 may be actuated by a knob 60, which is mechanically secured to the guide support 46. The knob 60 extends through a slot 62 defined in the jack stand, and may be manually slid towards or away from the lifting post 40.

Referring back to FIG. 2, at the top of the lifting post 40, a shaped support surface 48 is used to allow an object being lifted to rest on the lifting post 40 in a stable manner. The lifting post 40 may have only one support surface 48, or the post may have smaller support surfaces 38 on either side of a larger, central support surface 48. These additional support surfaces 38 allow the user to support more than one element of the object being lifted, providing greater security and stability.

Figure 3:
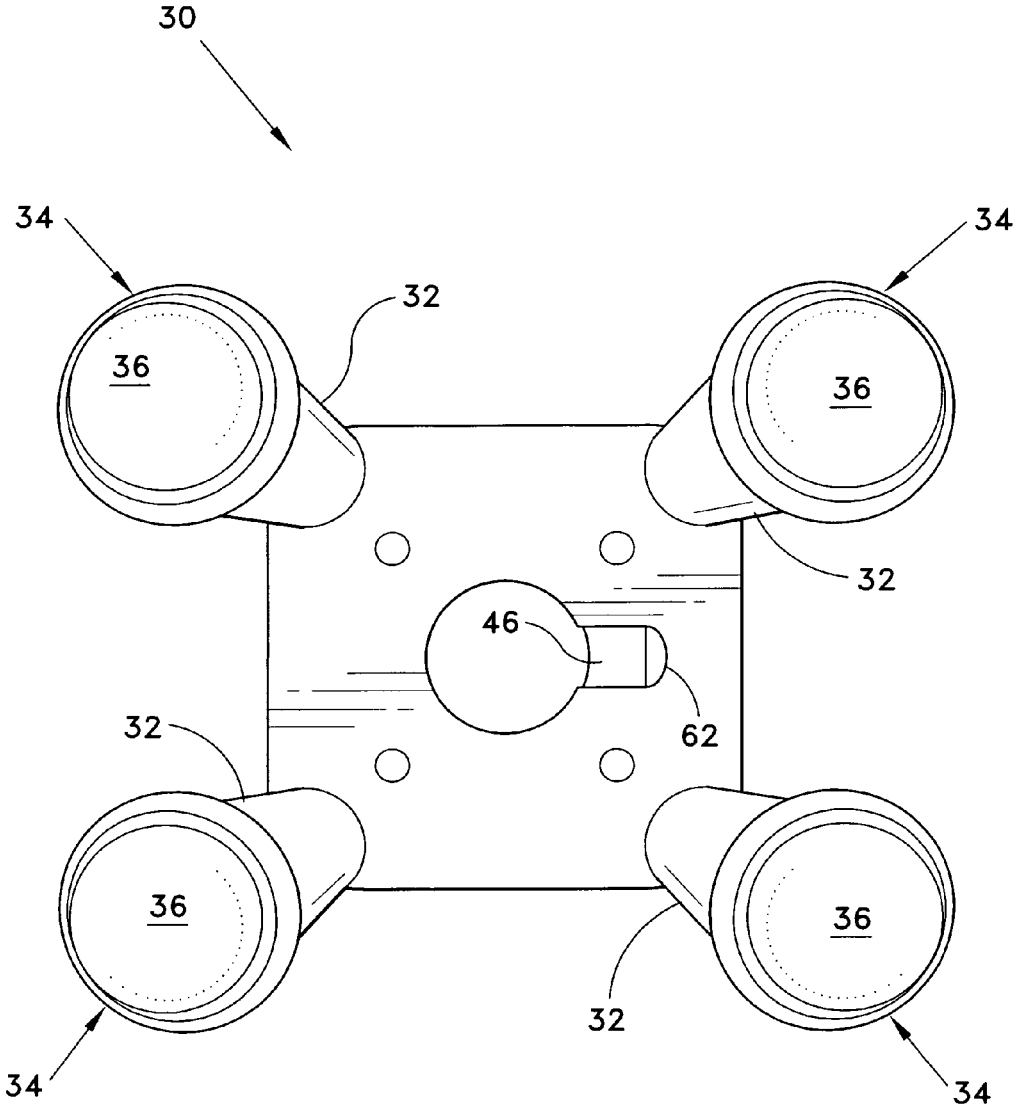
FIG. 3 is a bottom view of the jack stand according to the present invention.

The jack stand 30 has several legs 32, which extend out to provide a wide base, as shown in FIG. 3. The legs 32 generally splay downwardly from the top of the hydraulic cylinder 50, and are wider near the bottom than at the top. The legs 32 are slightly curved in cross-section, to provide greater strength, and have flat, horizontal feet 34 to help stabilize the stand 30 on a flat surface such as the ground. The feet 34 have pads 36 underneath to protect the feet 34 from wear and to help prevent the stand 30 from slipping. The pads 36 are made from a non-slip, durable, elastic or elastomeric material, such as rubber or a closed cell foam material.

It is to be understood that the present invention is not limited to the embodiments described above, but encompasses any and all embodiments within the scope of the following claims.

I claim:

1. A hydraulic jack stand, comprising:

a lifting post for supporting a heavy object;

a hydraulic cylinder for raising and lowering said lifting post;

a handle for operating said hydraulic cylinder;

one or more teeth pivoted outwardly from said post;

a guide support with a surface to engage one of said teeth at a time; each said tooth dimensioned and configured to selectively engage said support surface, and support said post and any load thereupon; and a plurality of legs extending from said hydraulic cylinder, such that said legs support said hydraulic cylinder in a stable manner.

2. The hydraulic jack stand according to claim 1, wherein each of said teeth pivotally mounted on said lifting post, are dimensioned such that, when said lifting post is raised, said tooth retracts to allow said lifting post to raise freely, while when said lifting post is lowered, said tooth remains positioned outward from said lifting post, such that said guide support surface may support said tooth and prevent said lifting post from lowering unintentionally; and a means for releasing said guide support to allow said lifting post to be lowered.

3. The hydraulic jack stand according to claim 1, further comprising at least one convex support surface at the top of said lifting post, such that an object to be lifted may rest on said support surface in a stable manner.

4. The hydraulic jack stand according to claim 1, wherein each of said legs further comprise a foot disposed on the bottom end of said leg, said foot providing a flat, horizontal surface on which said leg may rest on the ground in a stable manner.

5. The hydraulic jack stand according to claim 4, wherein said feet further comprise non-slip material pads secured therebeneath, each foot, said pads providing a protective cover for each foot and also preventing said hydraulic jack stand from slipping along the ground during use.

6. The hydraulic jack stand according to claim 1, wherein said guide support is movable horizontally to a tooth engaging position, there further being a handle attached thereto for moving said guide support surface into and out of engagement with a tooth.

7. The hydraulic jack stand according to claim 1, where said support legs are four in number.

8. A hydraulic jack stand comprising a hydraulic cylinder, a post extended from said cylinder and moveable vertically from said cylinder, a movable guide support surface adjacent said post and moveable horizontally with respect thereto, a plurality of moveable teeth in said post, each dimensioned and configured to extend outwardly and engage said support surface, and handle means for moving said support surface selectively beneath one of said plurality of teeth.

9. The hydraulic jack stand according to claim 8, there further being a plurality of support legs associated with and supporting said cylinder.

10. The hydraulic jack stand according to claim 9, wherein said legs are four in number.

11. The hydraulic jack stand according to claim 9, wherein the bottoms of said legs are provided with non-slip material foot pads.

12. The hydraulic jack stand according to claim 8, wherein the upper end of said post includes an integral, symmetrical support block thereupon, for directly engaging a load.

13. The hydraulic jack stand according to claim 12, said support block including at least three support cradles form integrally thereupon.

14. The hydraulic jack stand according to claim 13, said support cradles including a central cradle with two, outboard cradles of smaller dimensions than said central cradle.

15. A hydraulic jack stand, comprising:

a lifting post for supporting a heavy object;

a hydraulic cylinder for raising and lowering said lifting post;

a handle for operating said hydraulic cylinder;

one or more teeth pivoted outwardly from said post;

a guide support with a surface to engage one of said teeth at a time; each said tooth dimensioned and configured to selectively engage said support surface, and support said post and any load thereupon;

a plurality of legs extending from said hydraulic cylinder, such that said legs support said hydraulic cylinder in a stable manner, each of said teeth pivotally mounted on said lifting post being dimensioned such that, when said lifting post is raised, said tooth retracts to allow said lifting post to raise freely, while when said lifting post is lowered, said tooth remains positioned outward from said lifting post, such that said guide support surface may support said tooth and prevent said lifting post from lowering unintentionally; and a means for releasing said guide support to allow said lifting post to be lowered;

said legs each including a non-slip material pad on the bottom thereof.

* * * * *